US005522496A

United States Patent [19]

Wöstenfeldt

[11] Patent Number: 5,522,496

[45] Date of Patent: Jun. 4, 1996

[54] BOX FILE

[75] Inventor: Kurt D. Wöstenfeldt, Mondeor, South Africa

[73] Assignee: Dita Products (Proprietary) Limited, Johannesburg, South Africa

[21] Appl. No.: 327,682

[22] Filed: Oct. 21, 1994

[51] Int. Cl.[6] ..... B65D 5/50

[52] U.S. Cl. ..... 206/736; 206/425; 206/758

[58] Field of Search ..... 206/44, 45.18, 206/45.15, 425

[56] References Cited

U.S. PATENT DOCUMENTS

| | | | |
|---|---|---|---|
| 522,237 | 7/1894 | Sexton | 206/443 |
| 3,150,812 | 9/1964 | Sabol | 206/44 R |
| 4,449,628 | 5/1984 | Egly et al. | 206/425 |
| 4,496,050 | 1/1985 | Kirchner et al. | 206/45.15 |
| 4,693,364 | 9/1987 | Wakelin | 206/45.18 |

*Primary Examiner*—David T. Fidei
*Attorney, Agent, or Firm*—Henderson & Sturm

[57] ABSTRACT

This invention relates to an open topped box file which includes a rectangular base, side walls which are connected to the base, a hinge arrangement on the base which enables the side walls to be moved away from each other and bridge elements which extend between the ends of the side walls with the bridge elements being extensible to enable the side walls to be moved away from each other.

6 Claims, 1 Drawing Sheet

BOX FILE

FIELD OF THE INVENTION

This invention relates to a box file for holding a stack of loose papers, relatively thin file covers and the like.

BACKGROUND OF THE INVENTION

Box files of the above type are well known and a popular type of open topped box file is made from a semi-rigid plastics material and consists of a base, vertical side walls and end walls which join the side walls to each other. A major difficulty with box files of this type is that when they are fully loaded and a single paper or file is required from the contents of the box the entire contents needs to be removed from the box to enable the papers or files to be leaved through to locate the required document or file. This having been done, the entire pack of files or papers needs to be compressed into a bundle and reinserted into the box. To again replace the document the tedious process of again removing all of the papers, relocating the withdrawn paper and replacing the papers in the box needs to be performed.

OBJECT OF THE INVENTION

It is the object of this invention to provide a box file of the above type in which a particular document in the file is more easily accessible than described above without the need for removing the entire pack of documents from the file.

SUMMARY OF THE INVENTION

A box file which is made from a semi-rigid material including a flat rectangular base, side walls which are located on opposite sides of and connected to the base and bridge elements which extend between the ends of the side walls according to the invention is characterised in that the side walls are movable away from each other about a hinge arrangement on the base and the bridge elements are extensible to enable the side walls to be so moved.

In one form of the invention the base hinge arrangement includes a hinge connection between an edge of the base and one of the side walls. Preferably, however, both side walls are connected to the base by hinges.

In another form of the invention the side walls are fixed perpendicularly to opposite edges of the base and the base is divided into two panels by a central hinge which is parallel to the edges of the base which carry the side walls.

Further according to the invention at least one of the bridge elements includes a catch arrangement for holding the side walls perpendicular to the base.

In a preferred form of the invention the bridge elements are end walls which bridge the side walls at opposite ends of the box file with each end wall including two overlapping end wall portions with each of the portions of each pair being connected to one of the side walls free of the base and a connector arrangement on at least one pair of side wall portions, which is adapted to enable the side walls to be moved away from each other, joining one end wall portion of each pair of end wall portions to the other.

The connector arrangement may comprise an elongated slot in one of the end wall portions of each pair of end wall portions with the slot extending at least partially across the end wall portion between the side walls and a headed stud which is fixed to and projects from the other end wall portion through the slot to hold the overlapping end wall portions slidably together.

Each pair of end wall portions may include at least two of the connection arrangements which are spaced from each other between the upper and lower portions of the wall pair.

Still further according to the invention the box file is made from a resilient plastics material and at least one of the connector arrangement slots includes adjacent at least one of its ends a detent formation which projects into the slot to provide the catch arrangement for holding the stud at that end of the slot and over which the stud may be moved by resilient deformation of the detent formation.

BRIEF DESCRIPTION OF THE DRAWINGS

An embodiment of the invention is now described by way of example only with reference to the drawings in which.

DETAILED DESCRIPTION OF THE PREFERRED EMBODIMENT

In this embodiment of the box file of the invention the box is made from a suitable semi-rigid plastics material and includes a base 10, side walls 12 and 14, and two end walls 16 which are situated at opposite ends of the box.

Figure 1:
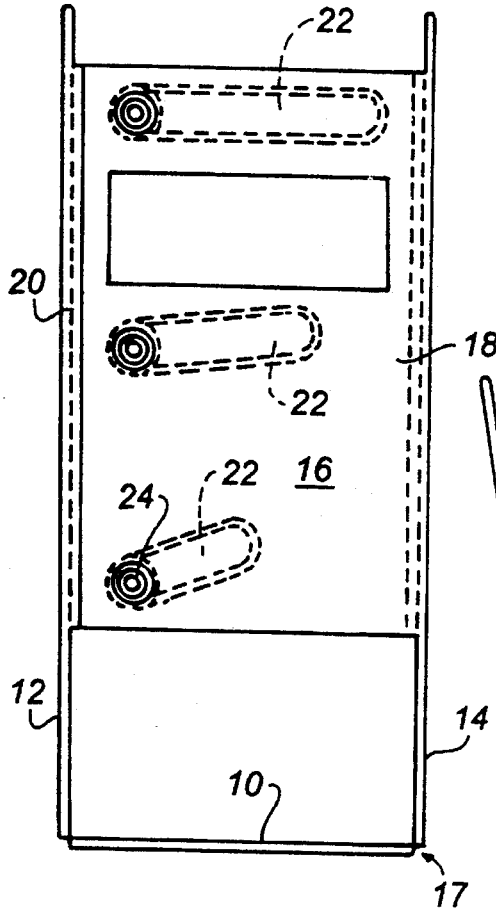
FIG. 1 is an end elevation of the box file of the invention.
Figure 2:
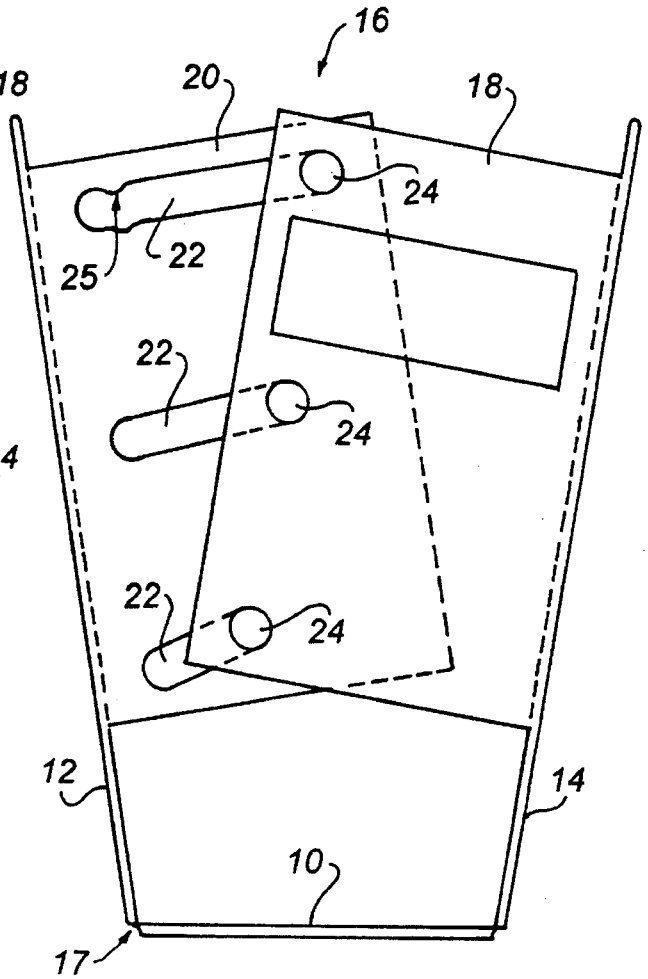
FIG. 2 is a view similar to that of FIG. 1 showing the side walls of the box moved away from each other.

The side walls 12 and 14 are connected by any suitable hinge-type arrangement 17 to the base 10 so that the side walls are easily movable between the positions illustrated in FIGS. 1 and 2.

Each of the end walls 16 of the box file is composed of overlapping end portions 18 and 20 with the end portion 18 being attached to the wall 14 and the portion 20 to the wall 12. The end wall portions are dimensioned to overlap one another as shown in FIG. 1 when the box is in its normal or closed position. The wall 20, in this embodiment of the invention, carries three elongated slots 22 and the portion 18 carries three holes which are in register with the ends of slots in the two positions of movement of the side walls as shown in FIGS. 1 and 2.

Figure 3:
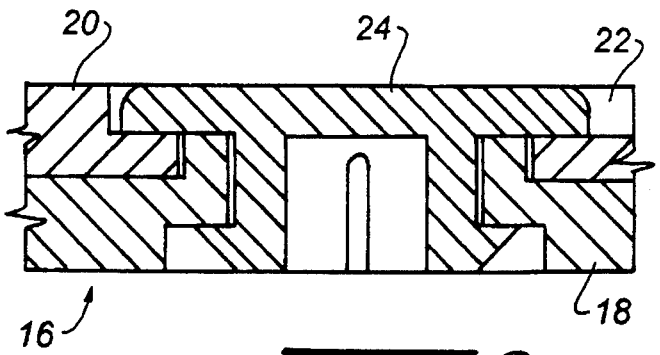
FIG. 3 is a cross sectional plan view of one of the connectors which connect the two side wall portions of the box of FIGS. 1 and 2 together.

Studs 24 are passed through the slots and anchored in the holes in the end wall portion 18 as illustrated in FIG. 3. From this drawing it will be seen that both the holes through the end wall portions 18 and the slots 20 are stepped to accommodate the studs 24. The studs 24 are shaped as shown in FIG. 3 and are merely pressed through the slots 22 and the holes in the end wall portion 18 until catches on the free end of the stem of the stud engage in the stepped portion of the holes in the end wall portion 18 as shown in the drawing.

The material from which the box file is made is resilient so that as the studs 24 are moved from the FIG. 1 to the FIG. 2 position in the slots 22 they slightly resiliently deform the upper surfaces of the slots 22 in travelling between the FIG. 1 and FIG. 2 positions on the radius of curvature of the swing of the two end wall portions so that the studs almost clip into their relaxed positions at the two ends of the slots 22. To ensure positive locking of the box file in the FIG. 1 closed position, one or more of the slots 22 could be deformed as shown on the upper slot in FIG. 2 to provide a detent 25 which the portion of the stud in the slot is pressed over by resilient deformation of the plastic material to be firmly locked in the slot at its end. The or each slot 22 could of course include a detent catch 25 at one or both of its ends.

In use, the box file is loaded with file covers or papers in the normal manner with the box in the FIG. 1 position. When the box file is completely filled and access is necessary to one of the papers or files in the box file the upper ends of the side walls are merely pulled apart to cause the studs 24 to move in the slots 22 from the FIG. 1 to the FIG. 2 position in which at least the upper portions of the documents in the box file are spread from each other for ease of leafing. To close the box file the upper ends of the side walls are merely pressed towards each other to cause the studs to travel through the slots from the FIG. 2 to the FIG. 1 position.

The invention is not limited to the precise details as herein described and in another form of the invention the end wall portions 18 and 20 could be replaced by arms which are attached to the side walls and which are pivotally connected to each other on the vertical centre line through the ends walls of the box file. The length of the arms could be such that in the closed position of the box file, as illustrated in FIG. 1, the pivot connection would lie above the horizontal position at which the arms are attached to the side walls of the box and when moved downwardly to just below the horizontal position in which the pivot connection is slightly over centre the side walls of the box would be moved to the FIG. 2 position. Additionally the lower edges of the side walls 12 and 14 could be fixed to the edges of the base and the base 10 of the box file could be centrally hinged in place of the hinges at the bases of the side walls.

I claim:

1. A box file made from a semi-rigid material, said box file comprising a flat rectangular base, two side walls on opposite sides of and connected to the base, a hinge arrangement on and extending over the length of the base to enable the side walls to be moved away from each other, end walls which bridge the side walls at opposite ends of the box file, wherein each end wall comprises a pair of overlapping end wall portions which are each attached to a side wall, and two connector arrangements which are vertically spaced from the base joining the end wall portions of each end wall, wherein each of the connector arrangements comprises an elongated slot in one of the end wall portions of each pair of end wall portions, said elongate seat extending at least partially across an end wall portion between the side walls, and a headed stud which is fixed to and projects from an other end wall portion of the pair of overlapping end wall portions through the slot to hold the pair of overlapping end wall portions slidably together to enable the side walls to be moved away from each other.

2. A box file as claimed in claim 1, wherein the hinge arrangement comprises a hinge connection between an edge of the base and one of the side walls.

3. A box file as claimed in claim 2, wherein each of said side walls are connected to the base by a hinge.

4. A box file as claimed in claim 1, wherein the side walls are fixed perpendicularly to opposite edges of the base and the base is divided into two panels by a central hinge which is parallel to the edges of the base which carry the side walls.

5. A box file as claimed in claim 1 comprising a catch arrangement for holding the side walls perpendicular to the base.

6. A box file as claimed in claim 1, wherein the box file comprises resilient plastics material, and at least one of the connector arrangement slots in one of the end walls comprises, adjacent at least one of its ends, a detent formation which projects into the slot to provide a catch arrangement for holding the stud at that end of the slot and the side walls of the box file parallel to each other and over which the stud may be moved by resilient deformation of the detent formation.

* * * * *